US006126120A

United States Patent [19]

Quaranta et al.

[11] Patent Number: 6,126,120

[45] Date of Patent: Oct. 3, 2000

[54] SUSPENSION CRADLE FOR SUPPORTING A HANGING HEAT EXCHANGER

[75] Inventors: Alain Quaranta, Fontenay les Bris; Arnaud Vallon, Issy les Moulineaux, both of France

[73] Assignee: Alstom France S.A., Paris, France

[21] Appl. No.: 09/334,608

[22] Filed: Jun. 17, 1999

[30] Foreign Application Priority Data

Jun. 18, 1998 [FR] France ..... 98 07684

[51] Int. Cl.[7] ..... E21F 17/02; F16L 3/00

[52] U.S. Cl. ..... 248/58; 248/61

[58] Field of Search ..... 248/58, 61, 65, 248/68.1

[56] References Cited

U.S. PATENT DOCUMENTS

| | | | |
|---|---|---|---|
| 1,466,292 | 8/1923 | Bell | 248/58 |
| 3,527,261 | 9/1970 | Bigler et al. | 122/510 |
| 3,843,080 | 10/1974 | Imai et al. | 248/58 |
| 4,013,024 | 3/1977 | Kochey et al. | 110/349 |
| 4,516,750 | 5/1985 | Brunner | 248/58 |
| 5,921,509 | 7/1999 | Flood et al. | 248/58 |

FOREIGN PATENT DOCUMENTS

| | | |
|---|---|---|
| 0 800 037 A2 | 10/1997 | European Pat. Off. . |
| 1 022 599 | 1/1958 | Germany . |

*Primary Examiner*—Ramon O. Ramirez
*Assistant Examiner*—Jerome A. DeLuca
*Attorney, Agent, or Firm*—Sughrue, Mion, Zinn, Macpeak & Seas, PLLC

[57] ABSTRACT

A suspension cradle for supporting a hanging heat exchanger having vertical tubes, the heat exchanger including at least one heat-exchanger element having a plurality of tubes grouped together in the same plane and connected to a manifold at each of their ends, the cradle including two main beams situated parallel to and on either side of the manifold, and at least one transverse support fastened transversely to the main beams, the transverse support supporting the heat-exchanger element, wherein the transverse support is in the shape of an upside down triangular rafter truss, and wherein the heat-exchanger element bears down against the bottom portion of the truss at a joint portion where the two branches meet to form the tip of the truss.

6 Claims, 2 Drawing Sheets

SUSPENSION CRADLE FOR SUPPORTING A HANGING HEAT EXCHANGER

The present invention relates to a suspension cradle for supporting a hanging heat exchanger having vertical tubes.

The invention is particularly applicable, for example, to supporting a hanging superheater in a boiler.

BACKGROUND OF THE INVENTION

Such a heat exchanger comprises an inlet manifold and an outlet manifold interconnected by vertical U-shaped tubes.

The tubes are grouped together in heat-exchanger elements of a few tubes per element. The tubes in the same element are disposed in the same plane, and the various elements are aligned one behind the other with a certain spacing between them.

In known manner, such a hanging heat-exchanger having vertical tubes is suspended from the roof structure of the building by means of two suspension cradles: namely a cradle for supporting the heat-exchanger elements in the vicinity of the inlet manifold, and a cradle for supporting the heat-exchanger elements in the vicinity of the outlet manifold.

A known suspension cradle conventionally comprises two main beams situated on either side of the manifold, and suspended from the roof structure by rods, and a succession of transverse supports fastened transversely to the main beams.

The transverse supports are thus disposed one behind the other, and each support supports one heat-exchanger element. Each transverse support is a crosspiece made up of two channel-section members flanking the tubes of a heat-exchanger element. The two section members are interconnected at their ends by pieces that keep them spaced apart. The tubes of a heat-exchanger element thus rest on the crosspiece via a bush welded to one of the tubes of the heat-exchanger element, the tubes also being connected together.

Thus, the transverse supports constitute a succession of crosspieces fastened along main beams subjected to bending stress. The supports, whose rated temperature is high (550° C. to 570° C.), need to have considerable inertia and therefore need to be of considerable weight.

OBJECTS AND SUMMARY OF THE INVENTION

An object of the present invention is provide a suspension cradle making it possible to obtain a reduction in weight.

To this end, the invention provides a suspension cradle for supporting a hanging heat exchanger having vertical tubes, said heat exchanger comprising at least one heat-exchanger element comprising n tubes grouped together in the same plane and connected to a respective manifold at each of their ends, the cradle comprising two main beams situated parallel to and on either side of a manifold, and at least one transverse support fastened transversely to said main beams, a said transverse support supporting a said heat-exchanger element, wherein said transverse support is in the shape of an upside down triangular rafter truss, said heat-exchanger element bearing against the bottom portion of said truss at the join where the two branches meet to form the tip of the truss.

In a particular embodiment of the present invention, said transverse support in the shape of a triangular rafter truss is made up of two frames having said shape, the frames being interconnected and flanking said tubes of a said heat-exchanger element, said heat-exchanger element bearing against said truss via a bush welded to the central tube of said element and resting on a sleeve of rectangular outside section keeping the two frames of the truss spaced apart at the bottom tip of said truss, the sleeve being welded to the frames and provided with a through central hole matching the outside diameter of said central tube.

BRIEF DESCRIPTION OF THE DRAWINGS

An embodiment of the invention is described below with reference to the accompanying drawings, in which.

MORE DETAILED DESCRIPTION

Figure 1:
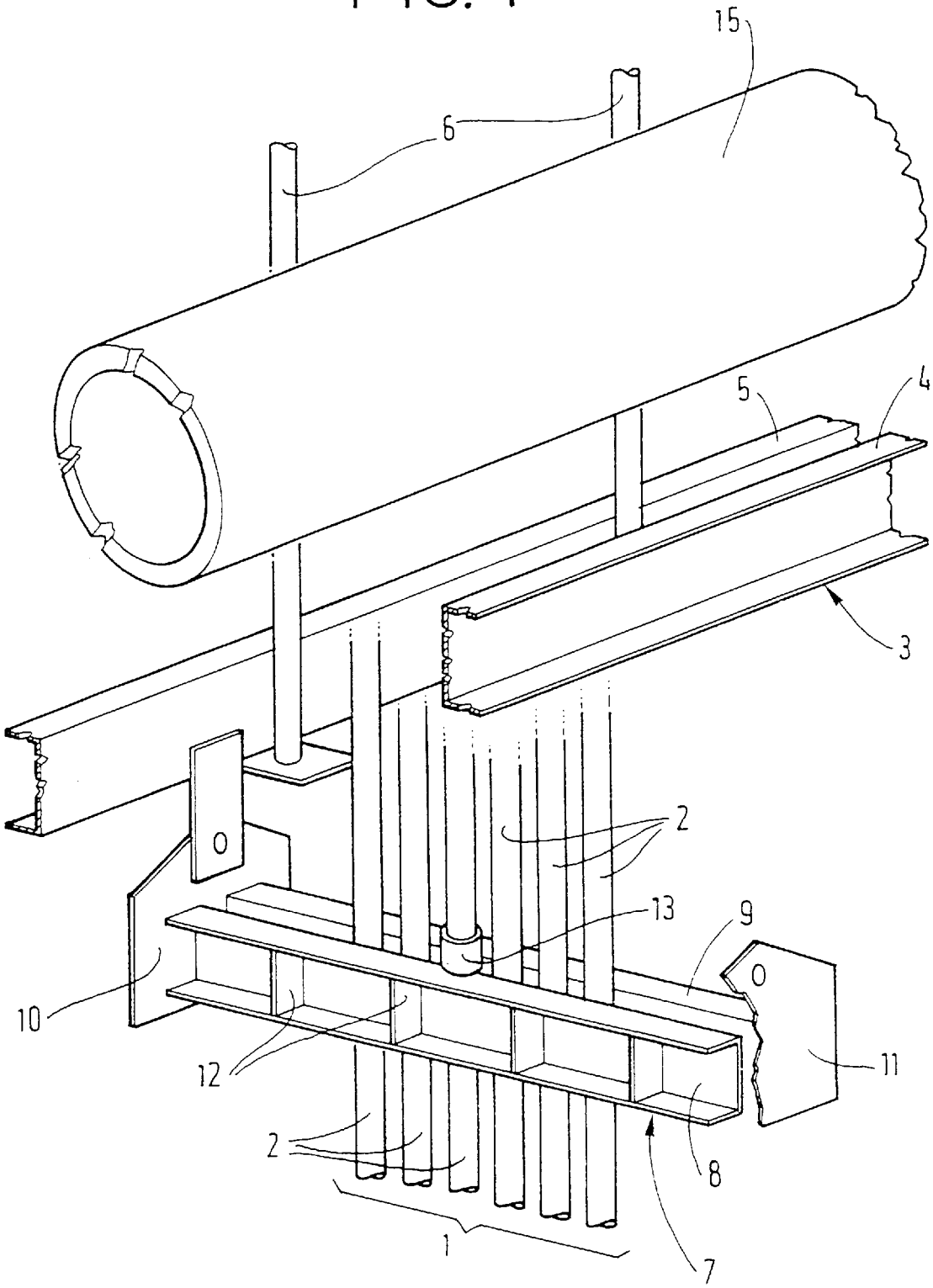
PRIOR ART FIG. 1
FIG. 1 is a fragmentary perspective view of a prior art suspension cradle as defined in the introduction, for suspending a hanging heat-exchanger having vertical tubes.

Thus, FIG. 1 is a fragmentary view of a known suspension cradle as defined in the introduction, for suspending a hanging heat-exchanger.

Only one element 1 is shown in this figure. In that example, the element comprises six tubes 2. At their top ends, the tubes are connected to a manifold 15. A plurality of such elements are thus disposed parallel to one another and one behind the other, and all of the tubes of all of the elements are connected to the same manifold 15. The tubes extend downwards and then turn up again in U-shape manner, and the other ends of the tubes are connected to a second manifold disposed parallel to the first manifold.

A complete heat exchanger is supported by two suspension cradles: one cradle at each manifold.

FIG. 1 is a fragmentary view of one of those cradles.

Such a suspension cradle supports the heat exchanger immediately below the manifold 15. As mentioned above, it includes two parallel main beams 3 situated on respective sides of the manifold. In FIG. 1, only one of the two beams 3 is shown. It is made up of two channel-section members 4 and 5 placed back-to-back. They are suspended from the roof structure of the building by rods 6.

Crosspieces 7 are fastened transversely to the main beams 3. Each crosspiece 7 supports a heat-exchanger element. In the figure, only one crosspiece 7 is shown, supporting the element 1 of a heat exchanger.

The crosspiece 7 is made up of two channel-section members 8 and 9 flanking the tubes 2 of the element 1.

The two section members are interconnected at their ends by link pieces 10 and 11. The section members 8 and 9 are provided with stiffener partitions 12.

The heat-exchanger element 1 is supported by the crosspiece 7 by means of a bush 13 welded to one of the tubes 2 of the element, and bearing directly against the section members 8 and 9 of the crosspiece. The link pieces 10 and 11 keep the section members 8 and 9 spaced apart by a distance equal to the outside diameter of the tubes 2. All the tubes 2 of the element 1 are interconnected by link means (not shown).

As it is easy to understand, such a crosspiece 7 supporting the element 1 is subjected to bending.

To support the element 1, the cross-piece that operates at high temperatures, i.e. temperatures greater than 500° C., must have very high bending strength and must be provided with numerous stiffener partitions 12. That crosspiece is thus of very considerable weight.

Figure 2:
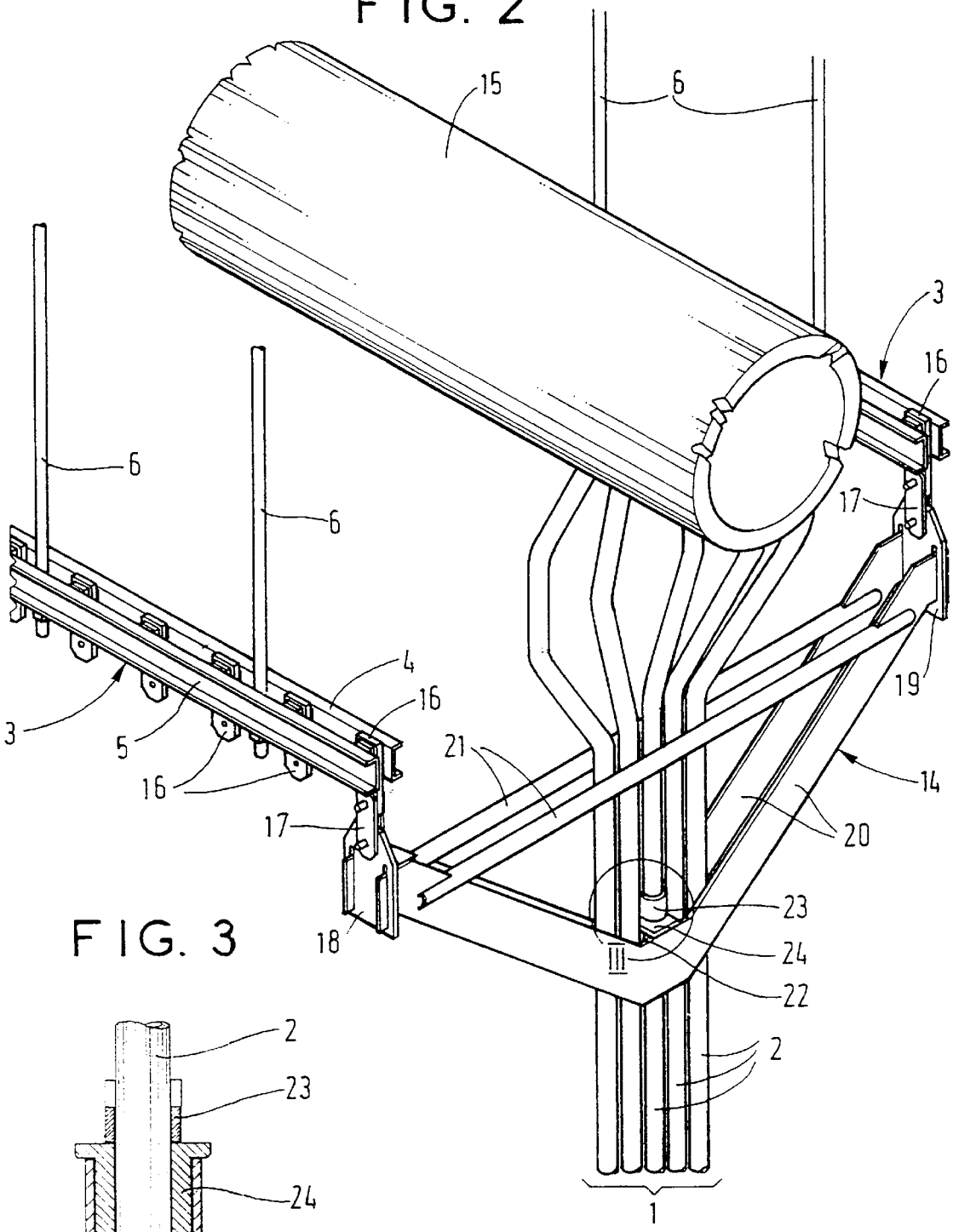
FIG. 2 is a fragmentary perspective view of a suspension cradle of the invention.

FIG. 2 shows a suspension cradle of the invention, in which cradle the crosspiece 7 is replaced by a transverse support 14.

In this figure showing the invention, the elements that are common to the invention and to the prior art are given like references. This figure shows the manifold 15 to which the tubes 2 of the element 1 are connected.

FIG. 2 shows only one element: the element 1, and therefore only one transverse support 14, but a plurality of elements (not shown) are supported in this way on other transverse supports aligned one behind the other and fastened to the main beams 3 by fastening means 16, 17.

In the invention, the transverse support 14 is in the shape of an upside down triangular rafter truss.

It is made of two triangular frames flanking the element 1 and interconnected by link pieces 18 and 19.

Each frame is formed by a metal sheet 20 cut to a V-shape, and by a link tube 21 interconnecting the top ends of the branches of the V-shape.

Figure 3:
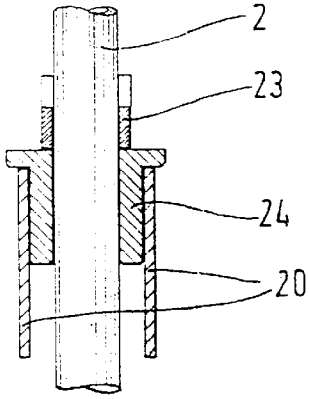
FIG. 3 shows the detail referenced III in FIG. 2.

The tip of the V-shape includes a small horizontal portion 22 to enable the element 1 to abut against it properly via one of the tubes 2 of the element, via a bush 23 welded to said tube, and via a sleeve 24 of rectangular outside section keeping the two frames 20 and 21 spaced apart at their tips. The sleeve 24 is shown in FIG. 3 and it is welded to the frames. It is provided with a central hole matching the outside diameter of the tube 2.

Thus, the element 1 rests in the tip of the V of the truss, thereby subjecting its branches to traction stress, while the horizontal bar 21 is subjected to compression stress. By means of this configuration, the transverse support 14 as a whole makes it possible to obtain a saving in weight of about 40% compared with the crosspiece 7 of FIG. 1.

The use of an abutment sleeve 24 for keeping the frames spaced apart enables the transverse supports 14 to be standard. Only the central hole of the sleeve needs to be matched to the outside diameter of the tube.

What is claimed is:

1. A suspension cradle supporting a hanging heat exchanger, the heat exchanger including at least one heat-exchanger element having a plurality of vertical tubes grouped together in a same plane, each of the vertical tubes connected to a manifold at one end of the tube, said cradle comprising:

two main beams parallel to the manifold and disposed on opposite sides of the manifold, and at least one transverse support fastened transversely to said main beams, said transverse support having two branches joined together at a joint portion disposed at a bottom portion of said transverse support so as to form an upside down triangular rafter truss which is transverse to said main beams, and said transverse support supporting the at least one heat-exchanger element at the joint portion.

2. The suspension cradle according to claim 1, wherein said transverse support comprises:

two frames, wherein each of said two frames is in a shape of the triangular rafter truss, the two frames being interconnected and flanking the tubes of the at least one heat-exchanger element; and a bush and sleeve disposed at said joint portion, said sleeve welded to said two frames at said joint portions and having a through hole; and wherein the at least one heat-exchanger element is supported by said transverse support via said bush welded to one of said tubes of the at least one heat-exchanger element and resting on said sleeve.

3. The suspension cradle according to claim 2, wherein said sleeve is welded to said joint portion so as to maintain a fixed separation between said two frames at said joint portion.

4. The suspension cradle according to claim 2, wherein said bush is welded to a center one of said plurality of tubes.

5. The suspension cradle according to claim 2, wherein said sleeve has a rectangular shape when viewed along a direction of a central axis of said through hole in said sleeve.

6. The suspension cradle according to claim 1, wherein the at least one heat-exchanger element is coupled to said joint portion at the bottom portion of said truss by a bush so that a weight of the heat-exchanger element bears down on said joint portion via said bush.

* * * * *